US011732397B2

(12) United States Patent
Brena et al.

(10) Patent No.: US 11,732,397 B2
(45) Date of Patent: Aug. 22, 2023

(54) FOAM PLUG FOR REDUCING NOISE IN A WASHING MACHINE APPLIANCE

(71) Applicant: Haier US Appliance Solutions, Inc., Wilmington, DE (US)

(72) Inventors: Martin Ortega Brena, Louisville, KY (US); Gregory Allen Dedow, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 748 days.

(21) Appl. No.: 16/822,166

(22) Filed: Mar. 18, 2020

(65) Prior Publication Data

US 2021/0292962 A1 Sep. 23, 2021

(51) Int. Cl.

| | |
|---|---|
| ***D06F 37/20*** | (2006.01) |
| ***D06F 39/12*** | (2006.01) |
| ***G10K 11/168*** | (2006.01) |
| ***D06F 33/48*** | (2020.01) |

(52) U.S. Cl.

CPC ..... *D06F 39/12* (2013.01); *D06F 33/48* (2020.02); *D06F 37/20* (2013.01); *G10K 11/168* (2013.01)

(58) Field of Classification Search

None

See application file for complete search history.

(56) References Cited

U.S. PATENT DOCUMENTS

| | | | | |
|---|---|---|---|---|
| 5,515,702 | A | 5/1996 | Park | |
| 5,965,851 | A * | 10/1999 | Herreman | B32B 11/10 181/290 |
| 6,512,831 | B1 | 1/2003 | Herreman et al. | |
| 9,453,296 | B2 | 9/2016 | Rockwell et al. | |
| 9,714,480 | B2 | 7/2017 | Rockwell et al. | |
| 10,458,059 | B2 * | 10/2019 | Christensen | D06F 58/20 |
| 10,619,920 | B2 * | 4/2020 | Schurr | F25D 23/00 |
| 2012/0169194 | A1 * | 7/2012 | Maderic | D06F 39/001 312/228 |
| 2013/0193826 | A1 * | 8/2013 | Fritz | A47L 15/4209 312/228 |
| 2014/0069146 | A1 * | 3/2014 | Clara | D06F 39/12 68/23.3 |

FOREIGN PATENT DOCUMENTS

| | | | | |
|---|---|---|---|---|
| CN | 1882737 | A | 12/2006 | |
| EP | 281688 | A1 | 9/1988 | |
| JP | H0714222 | Y2 | 4/1995 | |
| KR | 19990049037 | A | 7/1999 | |
| WO | WO-2005049910 | A1 * | 6/2005 | D06F 39/12 |

* cited by examiner

*Primary Examiner* — Steven M Marsh
(74) *Attorney, Agent, or Firm* — Dority & Manning, P.A.

(57) ABSTRACT

An appliance, such as a washing machine appliance, includes a cabinet comprising a wall defining an aperture configured for receiving support features during shipment of the appliance. When the appliance is installed, the support features are removed, leaving the aperture open and creating a path for noise transmission. Therefore, a sound reducing plug is configured for receipt within the aperture, the sound reducing plug being slightly oversized relative to the aperture such that an interference fit is formed between the sound reducing plug and the wall when the sound reducing plug is installed.

20 Claims, 4 Drawing Sheets

FOAM PLUG FOR REDUCING NOISE IN A WASHING MACHINE APPLIANCE

FIELD OF THE INVENTION

The present subject matter relates generally to washing machine appliances, and more particularly to sound reducing plugs for use in washing machine appliances.

BACKGROUND OF THE INVENTION

Laundry appliances, such as washing machine appliances and dryer appliances, typically include an external apron or cabinet that acts as a frame for supporting various components of the appliance, providing a clean look, and preventing a user from contacting internal components of the appliance. Certain laundry appliances include holes defined in the apron for receiving features for supporting internal components of the laundry appliances during shipment. For example, such support features may immobilize certain moving components that might move or vibrate excessively during transport, e.g., to prevent excessive noise and reduce component damage.

Notably, during the operation of both washing machines and dryer appliances, moving components that are immobilized during transport may generate vibrations and excessive noise. In general, the cabinet walls may serve to dampen or reduce the transmission of these noises to the area in which the appliance is installed. However, the aperture that is defined in the cabinet for receiving support features provides a large sound transmission path and can increase the amount of noise that escapes the cabinet. Certain appliances include features for reducing sound transmission through such apertures, but these features are typically complex, hard to install, and relatively ineffective at reducing sound transmission from the appliance.

Accordingly, a laundry appliance with improved features for reducing noise would be useful. More specifically, a washing machine appliance with a cabinet that is designed for reducing noise from escaping the cabinet would be particularly beneficial.

BRIEF DESCRIPTION OF THE INVENTION

Advantages of the invention will be set forth in part in the following description, or may be apparent from the description, or may be learned through practice of the invention.

In accordance with one exemplary embodiment of the present disclosure, a washing machine appliance is provided including a cabinet including a plurality of walls, at least one wall of the plurality of walls defining an aperture, and a sound reducing plug positioned within the aperture for reducing noise transmission through the aperture.

In accordance with another exemplary embodiment of the present disclosure, an appliance is provided including a cabinet including a wall, the wall defining an aperture configured for receiving support features during shipment of the appliance. In addition, a sound reducing plug is configured for receipt within the aperture, the sound reducing plug being slightly oversized relative to the aperture such that an interference fit is formed between the sound reducing plug and the wall when the sound reducing plug is installed.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
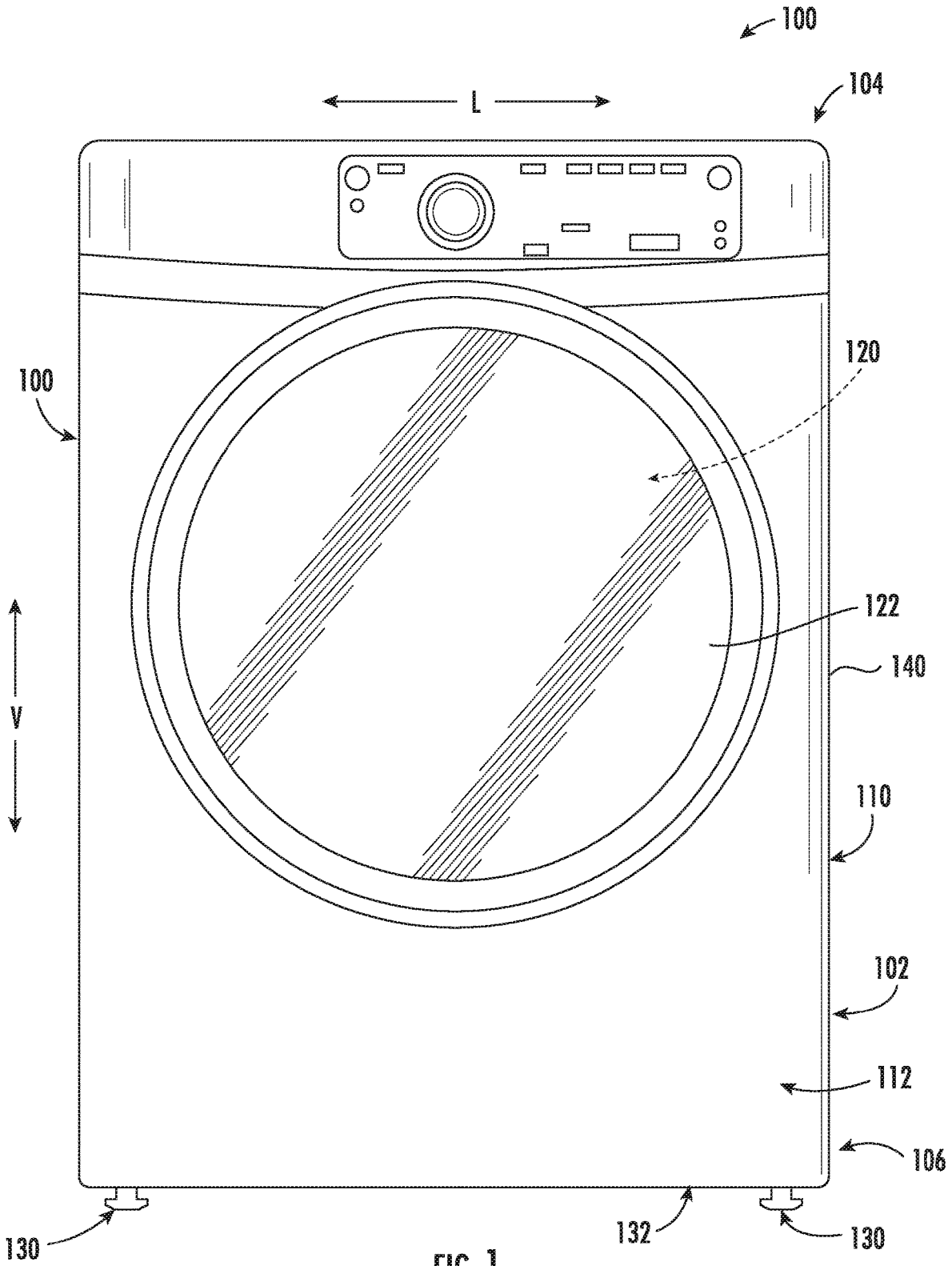
FIG. 1 provides a front view of a washing machine appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
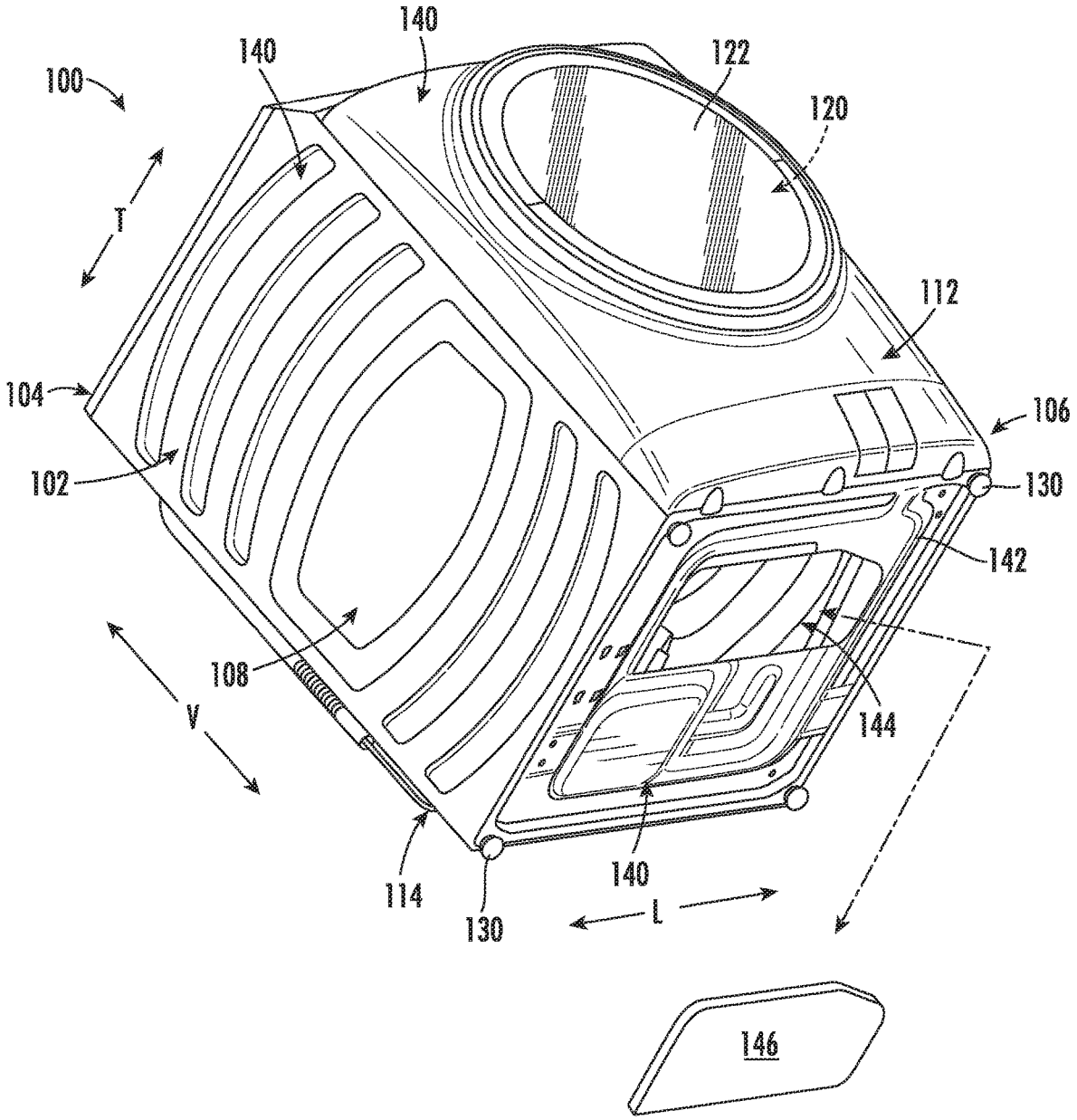
FIG. 2 provides a perspective view of the exemplary washing machine appliance of FIG. 1, illustrating a bottom wall of the cabinet and an aperture defined therein according to an exemplary embodiment.

Referring now to the figures, FIG. 1 is a front view of an exemplary horizontal axis washing machine appliance 100 and FIG. 2 is a perspective view of washing machine appliance 100. As illustrated, washing machine appliance 100 generally defines a vertical direction V, a lateral direction L, and a transverse direction T, each of which is mutually perpendicular, such that an orthogonal coordinate system is generally defined. Washing machine appliance 100 includes a cabinet 102 that extends between a top 104 and a bottom 106 along the vertical direction V, between a left side 108 and a right side 110 along the lateral direction, and between a front 112 and a rear 114 along the transverse direction T.

Within cabinet 102 is a container or wash basket (not shown) which defines a chamber 120 for receipt of articles, e.g., clothing, linen, etc., for washing. According to the illustrated embodiment, washing machine appliance 100 is a front load appliance, such that the wash basket and chamber 120 extend between a front portion and a back portion, e.g., along the transverse direction T and are rotatable about an axis that is parallel to the transverse direction T. However, it should be appreciated that according to alternative embodiments, aspects of the present subject matter may be applicable to top load washers and dryers, or to other appliance types, models, and configurations. A door 122 may be rotatably mounted to cabinet 102 for providing selective access to the wash basket and chamber 120.

As best shown in FIGS. 1 and 2, washing machine appliance 100 generally includes a plurality of washer leveling legs 130. Specifically, washing machine appliance 100 may include four washer leveling legs 130 which are positioned proximate the corners of a bottom panel or a bottom wall 132 of cabinet 102. In general, washer leveling legs 130 may generally have different sizes, positions, geometries, extension lengths, etc. Although exemplary leveling legs 130 are illustrated herein, it should be appreciated that the number, size, position, and geometries of such legs may vary while remaining within the scope of the present subject matter.

As best shown in FIG. 2, cabinet 102 of washing machine appliance 100 is formed from a plurality of walls 140. Specifically, walls or panels may generally form top 104, bottom 106, left side 108, right side 110, front side 112, a rear side 114 of cabinet 102. According to the illustrated embodiment, a bottom wall 142 of the plurality of walls 140 defines an aperture 144 that is generally configured for receiving support features (identified schematically by reference numeral 146) during the transport or shipment of washing machine appliance 100. Aperture 144 may generally be sized for receiving such support features 146. For example, according to an exemplary embodiment, aperture 144 defines an aperture cross sectional area and bottom wall 142 defines a wall cross-sectional area. According to exemplary embodiments, the aperture cross sectional area is greater than or about 10%, greater than or about 20%, greater than or about 50%, or greater, than the wall cross-sectional area.

As explained above, the support features 146 may generally be designed configured for immobilizing various moving internal components of washing machine appliance 100 to reduce noise, vibration, wear, or degradation of such components during shipment or transport of washing machine appliance 100. For example, according to an exemplary embodiment, support features 146 are inserted through aperture 144 and secured to various internal components to reduce their vibration. For example, the support features 146 may be rigid connecting structures are coupled directly to bottom wall 142. According still other embodiments, the support features 146 may include foam blocks constructed from expandable polystyrene (EPS) or any other suitable impact absorbing material. Notably, such support features 146 are only temporarily installed and typically must be removed before operating washing machine appliance 100. Thus, when a technician installs the washing machine appliance 100, the support features 146 are removed from aperture 144. Notably, as explained above, aperture 144 provides a path for noise transmission through cabinet 102. As will be described in more detail below, aspects of the present subject matter are directed to features for reducing such sound transmission.

Figure 3:
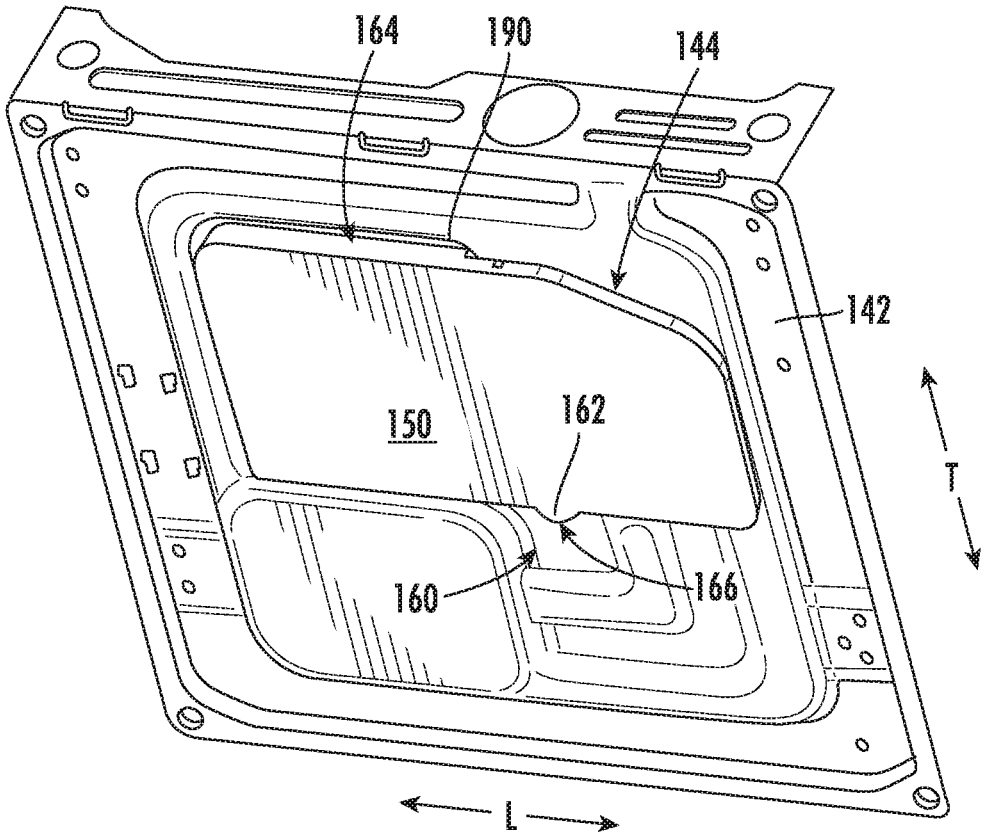
FIG. 3 provides a perspective view of the bottom wall of the exemplary cabinet of FIG. 2 including a sound reducing plug installed within the aperture according to an exemplary embodiment.
Figure 4:
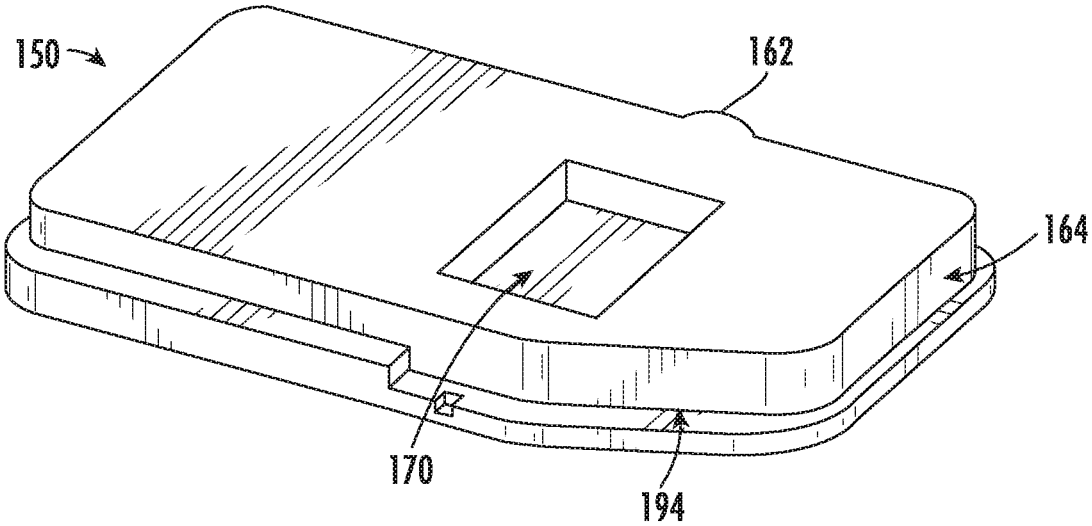
FIG. 4 provides a perspective view of the exemplary sound reducing plug of FIG. 3 according to an exemplary embodiment.
Figure 5:
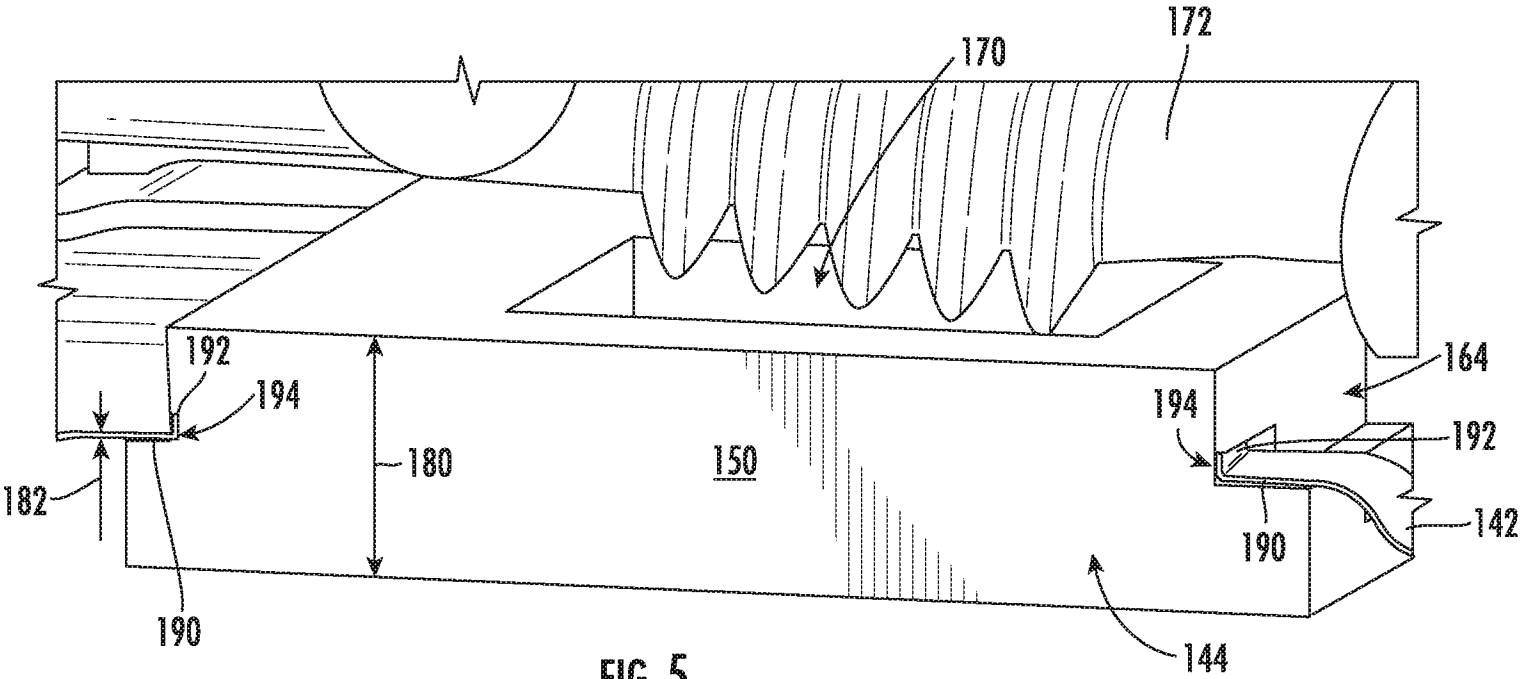
FIG. 5 provides a cross sectional view of the exemplary sound reducing plug installed in the bottom wall of the cabinet of the washing machine appliance of FIG. 1.

Specifically, referring now also to FIGS. 3 through 5, washing machine appliance 100 may further include a sound reducing plug 150 that is positioned within aperture 144 for reducing noise transmission through aperture 144. In practice, sound reducing plug 150 may be included with the shipment of washing machine appliance 100 and may be installed by a technician after removing the support features 146. In this manner, sound reducing plug 150 may block or substantially block all of aperture 144 and create a substantially sealed environment within cabinet 102 for reducing or damping noise generation from components housed therein. It should be appreciated that as used herein, terms of approximation, such as "approximately," "substantially," or "about," refer to being within a ten percent margin of error.

Although sound reducing plug 150 is illustrated herein as being installed in aperture 144 within bottom wall 142 of cabinet 102, it should be appreciated that aperture 144 may be defined in any other suitable wall 140 of washing machine appliance 100. For example, according to alternative embodiments, aperture 144 may be defined in a rear wall (e.g. defining rear 114 of cabinet 102) such that support features are inserted through the rear 114 of cabinet 102 to immobilize internal components during shipment. Sound reducing plug 150 may be inserted into aperture 144 during installation in the same manner as described above.

Notably, sound reducing plug 150 may be constructed from any suitable material that is sufficiently rigid to remain secured within aperture 144 and that can reduce sound transmission. For example, according to an exemplary embodiment, sound reducing plug 150 is constructed from machined foam or may be constructed from a plurality of foam layers that are cut to a desirable size and glued together to form sound reducing plug 150 of a desired shape. According to alternative embodiments, sound reducing plug 150 may be formed by injection molding, e.g., using a suitable plastic material, such as injection molding grade high impact polystyrene (HIPS) or acrylonitrile butadiene styrene (ABS). Alternatively, according to the exemplary embodiment, these components may be compression molded, e.g., using sheet molding compound (SMC) thermoset plastic or other thermoplastics.

Notably, sound reducing plug 150 and bottom wall 142 may define various features for facilitating the quick and easy installation of sound reducing plug 150. For example, according to the illustrated embodiment, sound reducing plug 150 defines at least one self-locating feature 160 for aligning sound reducing plug 150 within aperture 144. For example, sound reducing plug 150 and aperture 144 may have complementary shapes such that sound reducing plug 150 may only be installed in a particular orientation. According to the illustrated embodiment, the self-locating feature 160 may include a keyed protrusion 162 that extends from a perimeter 164 (e.g., an outer boundary defined within a horizontal plane) of sound reducing plug 150 and is configured for receipt within a complementary recess 166 defined within bottom wall 132 of cabinet 102. In this regard, sound reducing plug 150 may only be installed when keyed protrusion 162 is properly aligned with complementary recess 166. It should be appreciated that other self-locating features 160 are possible and contemplated as within the scope of the present subject matter.

As shown in the figures, sound reducing plug 150 may define a plurality of recesses, slots, indentations, cutouts, through holes, or other features suitable for receiving components of washing machine appliance 100. Specifically, according to the illustrated embodiment, sound reducing plug 150 may define at least one cut out 170 that is configured for receiving or providing relief for a hose 172 of washing machine appliance 100, e.g., as shown for example in FIG. 5. According to still other embodiments, cutouts 170 may be defined through sound reducing plug, e.g., for receiving an electrical wire, supply hose, etc.

It should be appreciated that sound reducing plug 150 may have any dimension suitable for securing sound reducing plug 150 within aperture 144 while providing sufficient noise reduction through aperture 144. For example, according to the illustrated embodiment, sound reducing plug 150 may define a nominal plug thickness 180 and bottom wall 132 may define a nominal wall thickness 182. According to exemplary embodiments, plug thickness 180 is greater than wall thickness 182. More specifically, according to the illustrated embodiment, plug thickness 180 is much greater than wall thickness 182, such as greater than 5 times, greater than 10 times, greater than 20 times, or greater than 50 times, wall thickness 182. In addition, according to an exemplary embodiment, sound reducing plug 150 when installed may extend from aperture 144 down to a floor (not shown) upon which to cabinet 102 is positioned. According to alternative embodiments, sound reducing plug 150 may be secured within aperture 144 and suspended above the floor.

Notably, sound reducing plug 150 may be sized or define features which simplify installation of sound reducing plug 150 into aperture 144. For example, according to the illustrated embodiment, sound reducing plug 150 is oversized relative to aperture 144 such that an interference fit is formed when sound reducing plug 150 is installed into aperture 144. In other words, aperture 144 and sound reducing plug 150 may define similar shapes within a horizontal plane (e.g., defined by the lateral direction L and the transverse direction T). However, sound reducing plug 150 may be slightly larger than aperture 144 such that it is securely received and held in place during operation of washing machine appliance 100.

In addition, according to an exemplary embodiment, aperture 144 may be defined by a perimeter flange 190 of bottom wall 132. In this regard, perimeter flange 190 defines the boundary of aperture 144 and may include a vertical lip 192 for improving rigidity of bottom wall 132. In addition, sound reducing plug 150 may define a perimeter groove 194 that is defined or extends around perimeter 164 of sound reducing plug 150 and is configured for engaging perimeter flange 190 when sound reducing plug 150 is inserted into aperture 144. In this regard, perimeter flange 190 fits into perimeter groove 194 when sound reducing plug 150 is pressed into aperture 144. It should be appreciated that other complementary features may be defined between aperture 144, a bottom wall 132, and sound reducing plug 150 for securing sound reducing plug 150 during operation of washing machine appliance 100. Notably, however, the features described herein facilitate installation of sound reducing plug 150 without the need for mechanical fasteners, adhesive, excessive force, or other complex installation procedures.

Although the figures and description herein refer to a washing machine appliance in order to facilitate discussion regarding the use of support features and a sound reducing plug, it should be appreciated that aspects of the present subject matter are not limited to this particular application. For example, it should be appreciated that other appliances may benefit from the use of apertures for receiving support features during transport and plugs for reducing or damping noise transmission during operation after installation. Thus, the use of sound reducing plugs in such appliances is contemplated as within the scope of the present subject matter. Indeed, any application where a device includes an apron or cabinet and that device may benefit from a reduction in noise transmission may utilize the present subject matter. It should be further appreciated that the present subject matter is not limited to the style or configuration of the appliances described herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance, comprising:

a cabinet comprising a plurality of walls, at least one wall of the plurality of walls defining an aperture; and a sound reducing plug positioned within the aperture for reducing noise transmission through the aperture, wherein the sound reducing plug defines at least one cutout configured for receiving a hose or an electrical wire.

2. The washing machine appliance of claim 1, wherein the at least one wall is a bottom wall of the plurality of walls.

3. The washing machine appliance of claim 1, wherein the aperture defines an aperture cross sectional area that is greater than 20% of a wall cross sectional area covered by the at least one wall in which the aperture is defined.

4. The washing machine appliance of claim 1, wherein the sound reducing plug is constructed from machined foam.

5. The washing machine appliance of claim 1, wherein the sound reducing plug is constructed from a plurality of layers of foam that are glued together.

6. The washing machine appliance of claim 1, wherein the sound reducing plug defines at least one self-locating feature for aligning the sound reducing plug within the aperture.

7. The washing machine appliance of claim 6, wherein the self-locating feature comprises a keyed protrusion extending from a perimeter of the sound reducing plug, the keyed protrusion configured for receipt within a complementary recess defined within the at least one wall that defines the aperture.

8. The washing machine appliance of claim 1, wherein the sound reducing plug defines a plug thickness and the at least one wall defines a wall thickness, the plug thickness being greater than the wall thickness.

9. The washing machine appliance of claim 8, wherein the plug thickness is greater than 10 times the wall thickness.

10. The washing machine appliance of claim 8, wherein the sound reducing plug, when installed, extends from the aperture down to a floor upon which the cabinet is positioned.

11. The washing machine appliance of claim 1, wherein the sound reducing plug is oversized relative to the aperture such that an interference fit is formed when the sound reducing plug is installed into the aperture.

12. The washing machine appliance of claim 1, wherein the aperture is defined by a perimeter flange of the at least one wall, and wherein the sound reducing plug defines a perimeter groove that is configured for engaging the perimeter flange.

13. The washing machine appliance of claim 12, wherein the perimeter flange snap fits into the perimeter groove when the sound reducing plug is installed into the aperture.

14. The washing machine appliance of claim 1, wherein the sound reducing plug is injection molded using plastic.

15. An appliance, comprising:

a cabinet comprising a wall, the wall defining an aperture configured for receiving support features during shipment of the appliance, wherein the wall defines a wall thickness; and a sound reducing plug configured for receipt within the aperture, the sound reducing plug being slightly oversized relative to the aperture such that an interference fit is formed between the sound reducing plug and the wall when the sound reducing plug is installed, wherein the sound reducing plug defines a plug thickness that is greater than the wall thickness.

16. The appliance of claim 15, wherein the aperture defines an aperture cross sectional area that is greater than 20% of a wall cross sectional area covered by the wall in which the aperture is defined.

17. The appliance of claim 15, wherein the sound reducing plug defines at least one self-locating feature for aligning the sound reducing plug within the aperture.

18. The appliance of claim 15, wherein the sound reducing plug defines at least one cutout configured for receiving a hose or an electrical wire.

19. An appliance, comprising:

a cabinet comprising a wall, the wall defining an aperture configured for receiving support features during shipment of the appliance, wherein the aperture is defined by a perimeter flange of the wall; and a sound reducing plug configured for receipt within the aperture, the sound reducing plug being slightly oversized relative to the aperture such that an interference fit is formed between the sound reducing plug and the wall when the sound reducing plug is installed, wherein the sound reducing plug defines a perimeter groove that is configured for engaging the perimeter flange.

20. The appliance of claim 19, wherein the perimeter flange snap fits into the perimeter groove when the sound reducing plug is installed into the aperture.

* * * * *